US006464454B1

(12) United States Patent
Kotkaniemi

(10) Patent No.: US 6,464,454 B1
(45) Date of Patent: Oct. 15, 2002

(54) CENTRIFUGAL PUMP

(75) Inventor: Leo Kotkaniemi, Älvängen (SE)

(73) Assignee: ABS Pump Production AB, Molndal (SE)

( * ) Notice: Subject to any disclaimer, the term of this patent is extended or adjusted under 35 U.S.C. 154(b) by 0 days.

(21) Appl. No.: 09/720,788

(22) PCT Filed: Jun. 29, 1999

(86) PCT No.: PCT/SE99/01170

§ 371 (c)(1),
(2), (4) Date: Feb. 12, 2001

(87) PCT Pub. No.: WO00/00745

PCT Pub. Date: Jan. 6, 2000

(30) Foreign Application Priority Data

Jun. 30, 1998 (SE) ..... 9802328

(51) Int. Cl.[7] ..... F01D 25/00
(52) U.S. Cl. ..... 415/121.1; 415/196
(58) Field of Search ..... 415/71, 121.1, 415/172.1, 173.1, 173.2, 196, 206, 207

(56) References Cited

U.S. PATENT DOCUMENTS

| | | | | | |
|---|---|---|---|---|---|
| 3,128,051 | A | | 4/1964 | Smith | |
| 3,447,475 | A | | 6/1969 | Blum | |
| 3,692,422 | A | | 9/1972 | Girardier | |
| 4,143,993 | A | | 3/1979 | Blum | |
| 4,264,271 | A | * | 4/1981 | Libertini | 415/173.3 |
| 4,854,819 | A | * | 8/1989 | Gullichsen | 415/143 |
| 4,932,837 | A | * | 6/1990 | Rymal | 415/206 |
| 5,011,370 | A | | 4/1991 | Sodergard | |
| 5,427,498 | A | * | 6/1995 | Lehe | 415/172.1 X |

FOREIGN PATENT DOCUMENTS

| | | | | | |
|---|---|---|---|---|---|
| DE | 2602624 | A1 | * | 7/1976 | 415/206 |
| DE | 2901638 | | * | 8/1979 | 415/121.1 |
| EP | 0013942 | | | 8/1980 | |
| GB | 2202585 | A | * | 9/1988 | 415/206 |
| IT | 376080 | | * | 2/1940 | 415/121.1 |
| JP | 85198 | A | * | 4/1987 | 415/196 |
| SE | 435 952 | | | 10/1984 | |

* cited by examiner

*Primary Examiner*—John E. Ryznic
(74) *Attorney, Agent, or Firm*—Pillsbury Winthrop LLP

(57) ABSTRACT

A centrifugal pump pumps fluid containing large or long objects of solid material. Solid parts cause problems with centrifugal pumps in that they both stick to the edge of the vanes of the pump wheel and get in between the pump wheel and the housing and stick to either one of these may cause the pump wheel to slow down or get stuck. Large parts may also form a bridge between two vanes. Objects which have become stuck to and rotate together with the pump wheel easily gather more objects and growth of the aggregate is often very rapid. In all of these cases the flow through the pump is distributed and the capacity of the pump is reduced. These problems are avoided with a centrifugal pump in which the edges of the vanes (11, 12, 13, 14) extend themselves continuously in the direction of the flow from the input adjacent the shaft and at an acute angle thereto to a lower part close to the wall (1-1A) of the housing and forwards in the direction of the flow of the pumped fluid.

4 Claims, 3 Drawing Sheets

CENTRIFUGAL PUMP

RELATED APPLICATIONS

This application is the national phase of international application PCT/SE99/01170 filed Jun. 29, 1999 which designated the U.S, and that international application was published under PCT Article 21(2) in English.

BACKGROUND OF THE INVENTION

The present invention refers to a centrifugal pump for fluids containing large or long solid objects. Primarily this means wooden chips, textile- and fibre parts, plastic and other solid pieces in the size order of 5–150 mm. Pumps according to the invention are especially intended for pumping of liquid which has a large content of solid material which may be up to about 50%.

PRIOR ART PROBLEMS

Solid objects cause problems when pumping with centrifugal pumps in that they both stick on the edges of the vanes of the pump wheel and force their way in between the pump wheel and the housing and get stuck to either one of these where they may cause the pump wheel to slow down or get stuck. The larger objects may also bridge between two vanes. Objects which have stuck and rotate together with the pump wheel easily gather more objects and the aggregate often grows rapidly. In all cases the flow through the pump is disturbed and its capacity is reduced. When such problems occur the pump has to be stopped and cleaned which often brings with it a stop for the entire process in which the pump is included.

OBJECTS OF THE INVENTION

The present invention is for a centrifugal pump in which the above mentioned drawbacks are avoided. The object of the present invention is a pump of the above mentioned kind such that as far as possible it is avoided that solid objects stick to the pump wheel or housing. It is another object of the invention to achieve release of stuck objects as soon as possible without having to stop the pump or take any other special action.

BRIEF DESCRIPTION OF THE DRAWINGS

The invention is described below with reference to exemplary embodiments which are shown in the enclosed figures, in which.

DETAILED DESCRIPTION OF THE INVENTION

Figure 1:
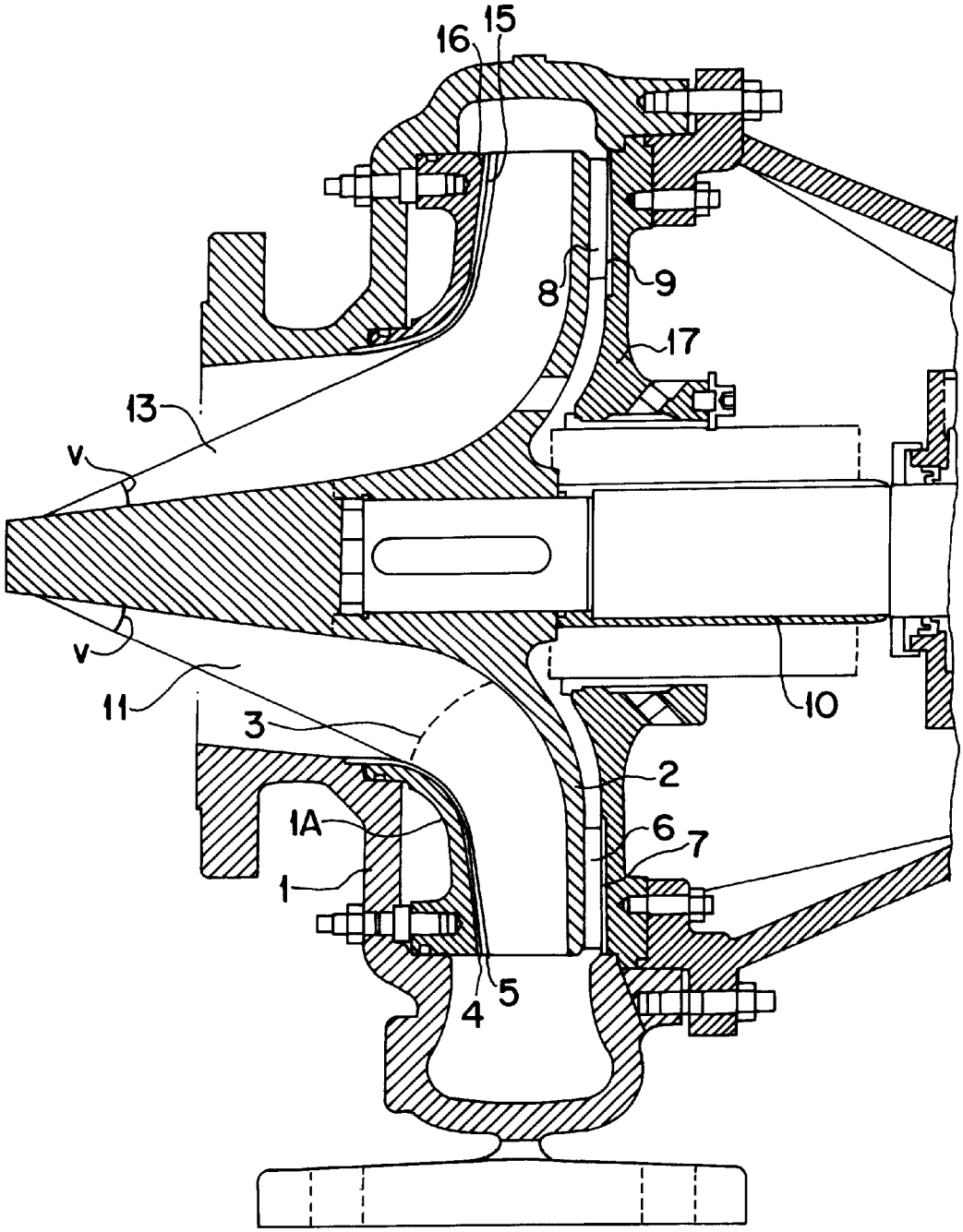
FIG. 1 is a cross-section of a pump according to the invention.

The pump shown in FIG. 1 has a conventionally designed housing 1 in which there is a pump wheel 2 which is connected to a driving shaft 10. In the embodiments shown in the figures the pump wheel has four vanes 11, 12, 13 and 14. The housing of the pump has an inner lining or wear disc 1A the inside of which is adapted to the shape of the vanes of the pump wheel. At the back of the pump wheel the housing comprises a pump cover 17. Bearing and sealing of the pump shaft is made in known manner.

In prior art pumps the vanes extend along the wear disc 1A (upwards in the lower half of FIG. 1) and end approximately along the broken line 3. In centrifugal pumps according to the invention the vanes extend themselves considerably farther towards the inflowing fluid, so that the edge of the vane which is closest to the outlet follows the inside wear disc 1A and continuously extends itself up to an extension of the shaft 10 and, in a plane in the direction of the pump shaft, is at an acute angle therewith. Long large objects can not stick to the front edges of the vanes but are directed into the pump wheel in a direction which generally coincides with the direction of the flow thus eliminating the risk of bridging between two adjacent vanes. Preferably the vanes also are at an acute angle to the shaft of rotation in a vertical plane at right angle to the plane which is shown in the figure.

Figure 2:
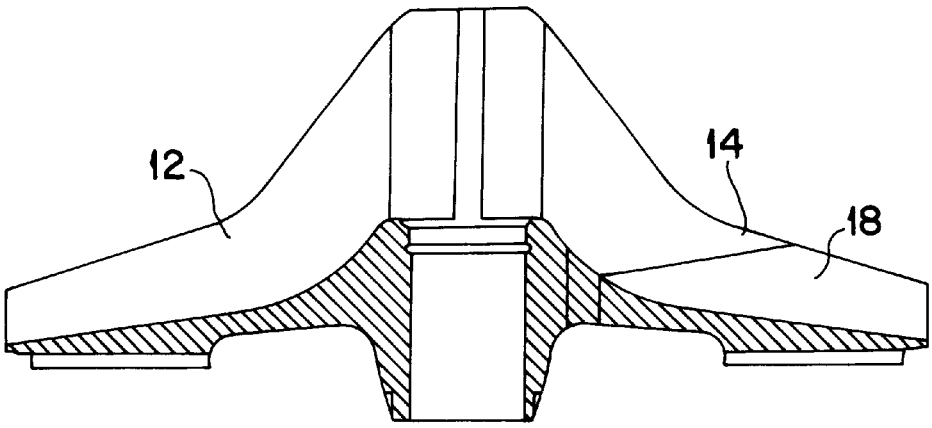
FIGS. 2 and 3 are respectively a cross-section and front view of a pump wheel of a pump according to the invention.
Figure 3:
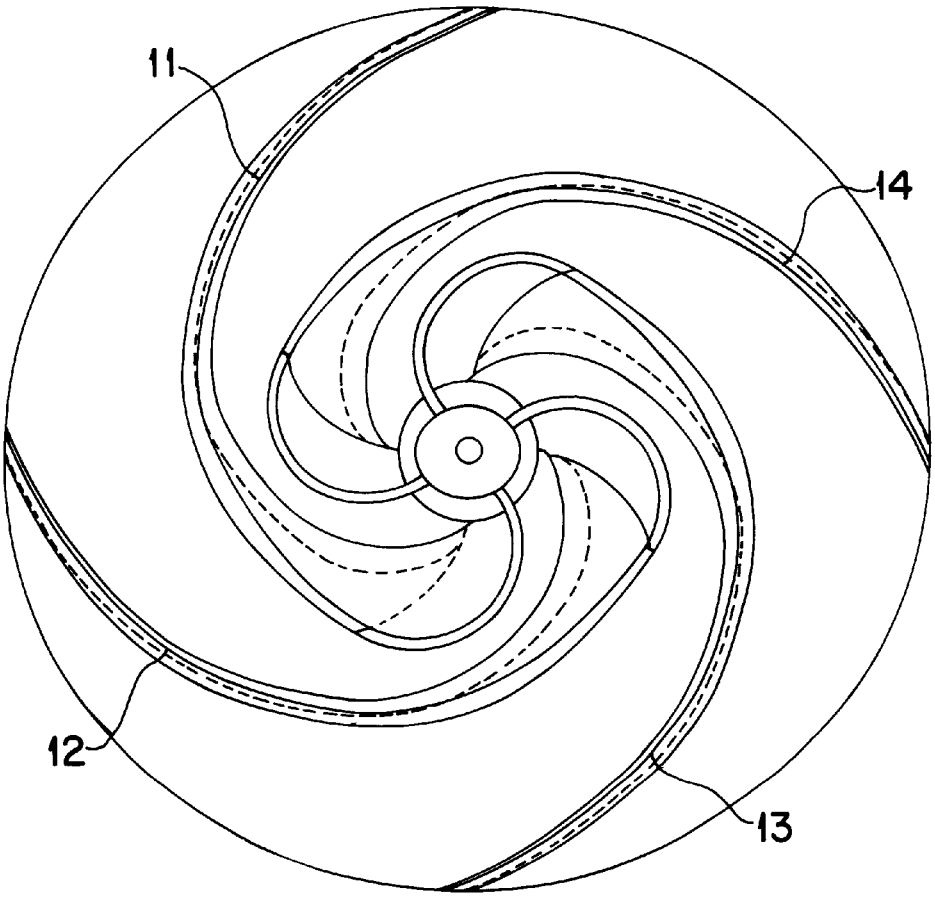
Figure 4:
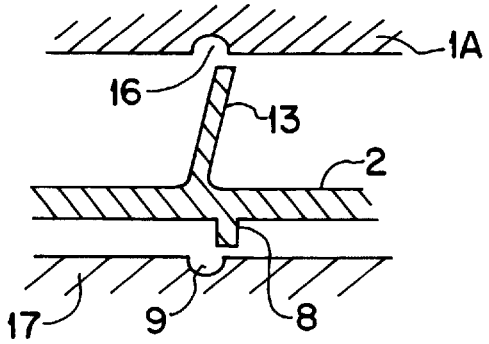
FIG. 4 is a cross-section of some parts of the pump of FIG. 1.

In some applications the pump wheel also has an intermediate vane in order to attain the required pressure during pumping. Such an intermediate vane 18 is shown in FIG. 2 from which is apparent that it starts some distance outwards on the pump wheel from its hub. The edge of the intermediate vane 18 slopes from the starting point slightly upwards from the plane of the pump wheel until it has the same height as the other, larger vanes 11, 12, 13, 14. From this point and on to the periphery of the pump wheel the intermediate vane 18 has mainly the same shape as the other vanes. The number of intermediate vanes is in most cases the same as the number of the other vanes. By this arrangement of the intermediate vanes it is achieved that solid particles do not stick to the intermediate vanes but are thrown at the wear disc 1A in the same way as at the other, larger vanes.

At the inside of the wall of the housing 1-1A there are one or more grooves 4, 16. The grooves extend themselves from the outer outlet channel in the housing along the whole of the part of the wall adjacent to the vanes and some distance further.

Figure 5:
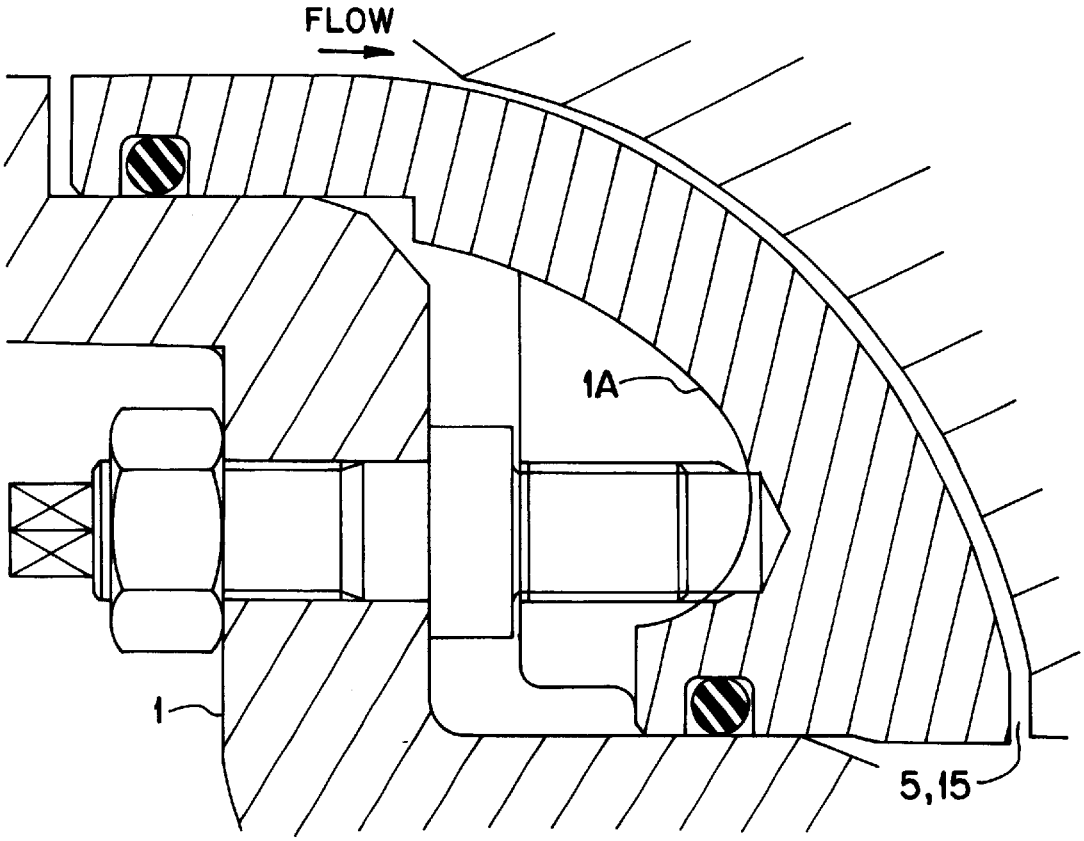
FIG. 5 is an enlarged view of a portion of FIG. 1.

Objects of a size such that they may get into the slit between a vane and the housing are hooked by the grooves 4, 16 and ground to pieces. The slit 5, 15 between a vane and the housing is so designed that it, at least at an end section thereof, widens in the direction of the flow and towards the periphery of the pump wheel as shown in FIG. 5. Due to this design all particles which get in between a vane and the housing are ground and conveyed out with the fluid flow.

The pump wheel may also have back side vanes 6, 8. In this case also the cover 17, which is facing the back of the pump wheel, has one or more grooves 7, 9. This brings with it that solid objects which get in between the pump wheel and the cover are ground when they are hooked by the grooves 7, 9 and hit by the back side vanes 6, 8. The slit between the pump wheel and the cover preferably widens continuously outwards from the shaft in order to make it easier for objects which have got into the slit to get out to the outlet channel.

Further embodiments of the centrifugal pump are possible within the framework of the inventive idea. The grooves both in the housing and the cover of the pump may in other embodiments of the invention be replaced by ridges or similar edges at the housing and the cover. The grooves or ridges may then form a straight or bent line along the surface at which they are positioned. They also ought to have a rounded bottom or outside to facilitate the loosening of temporarily stuck objects. The front part of the vanes may together with the corresponding part of the shaft be a separate addition to conventional pump wheels.

What is claimed is:

1. A centrifugal pump for pumping of liquid containing large solid parts, comprising:

a pump wheel having a shaft and vanes, a pump housing having an inner lining or wear disc having an inside adapted to a shape of said vanes, said vanes having edges extending continuously upstream from a point adjacent the lining or wear disc to said shaft forming an acute angle to said shaft, and between said pump housing and outer edges of said vanes, at least in a rear part thereof as seen in a flow direction, there being a slit (5, 15) which widens in said flow direction.

2. A centrifugal pump according to claim 1 wherein the housing has one or more grooves (4, 16) at a side which faces the edges of the vanes.

3. A centrifugal pump according to claim 2 wherein the housing has one or more ridges on a surface which faces said vanes.

4. A centrifugal pump according to any one of the preceding claims wherein the pump wheel has rear vanes (6, 8) and one or more grooves (7, 9) or corresponding ridges are arranged in or at the cover (17) of the housing.

* * * * *